United States Patent [19]

Kasai

[11] Patent Number: 4,608,735

[45] Date of Patent: Sep. 2, 1986

[54] SLIDING BAR BUCKLE

[75] Inventor: Kazumi Kasai, Namerikawa, Japan

[73] Assignee: Nippon Notion Kogyo Co., Ltd., Tokyo, Japan

[21] Appl. No.: 765,963

[22] Filed: Aug. 15, 1985

[51] Int. Cl.[4] ..... A44B 11/10

[52] U.S. Cl. ..... 24/196; 24/171; 24/194; 24/197

[58] Field of Search ..... 24/196, 171, 194, 197, 24/195, 68 CD, 163 R, 181

[56] References Cited

U.S. PATENT DOCUMENTS

| | | | |
|---|---|---|---|
| 1,729,608 | 10/1929 | Clark | 24/196 |
| 2,743,497 | 5/1956 | Davis | 24/196 |
| 2,754,560 | 7/1956 | Warner et al. | 24/196 |
| 3,274,656 | 9/1966 | Hamann | 24/196 |
| 3,365,756 | 1/1968 | Bayon | 24/196 |
| 3,407,451 | 10/1968 | Dewey et al. | 24/196 |
| 4,136,422 | 1/1979 | Ivanov et al. | 24/171 |
| 4,150,464 | 4/1979 | Tracy | 24/196 |
| 4,389,756 | 6/1983 | Kasama | 24/196 |
| 4,525,901 | 7/1985 | Krauss | 24/197 |

FOREIGN PATENT DOCUMENTS

| | | | |
|---|---|---|---|
| 961402 | 5/1950 | France | 24/196 |
| 947110 | 1/1964 | United Kingdom | 24/194 |

*Primary Examiner*—Victor N. Sakran

*Attorney, Agent, or Firm*—Hill, Van Santen, Steadman & Simpson

[57] ABSTRACT

A molded sliding bar buckle of the type comprising a strap retainer bar slidably mounted on an open rectangular connector frame having a grip base and a connecting bar on opposite sides of the strap retainer bar. The strap retainer bar includes a central strap engagement portion for retaining therearound one end portion of a strap and having on its back a sloped flat or substantially flat surface facing away from the grip base. The sloped surface has an upper end disposed adjacent to the connecting portion and a lower end disposed adjacent to the grip base, the upper end lying in a plane extending through a center of the thickness of the strap engagement portion. With this construction, when the strap is longitudinally tensioned with its one end portion looped around the strap engagement portion, a tensioning force is transformed substantially into a force or a vector acting in said plane in a direction to tend to move the strap retainer bar linearly toward the grip base. A component of the tensioning force which acts on the strap engagement portion to tend to rotate the strap retainer bar is substantially negligible. Thus, the strap end is held firmly against displacement.

3 Claims, 14 Drawing Figures

SLIDING BAR BUCKLE

BACKGROUND OF THE INVENTION

1. Field of the Invention

The present invention relates to an adjustable strap fastener of synthetic resin for adjustably interconnecting strap or belt ends on a bag or the like. More particularly, it relates to a sliding bar buckle having a strap retainer bar slidably mounted on a hollow or open rectangular frame for frictionally retaining a strap end.

2. Description of the Prior Art

Various adjustable strap fasteners or buckles have been proposed which may be manipulated to adjust the effective length of a strap on, for example, a bag. such fasteners are made of a plastic material formed into an integral molded structure which generally comprises a pair of laterally spaced legs, a grip base portion at one end of the legs, a connecting portion at the opposite end of the legs, and a plurality of cross bars disposed in between the grip base and connecting portions across between the legs. In use, one strap end portion is looped around one of the cross bars, passed under the connecting portion and secured in place as by stitching or rivetting. The other strap end portion which is adapted for length adjustment is looped around another cross bar, passed under the grip base portion and frictionally gripped therebetween against displacement. Such frictionally gripped strap tends to get loose when subjected to tensioning forces applied thereto. This tendency is less the smaller the gap between the grip base portion and the last-named cross bar, but the insertion or passage of the strap through the gap becomes more difficult.

An attempt has been made to overcome the foregoing difficulties, wherein a strap fastener includes an open rectangualr connector frame and strap retainer bar movably mounted on the frame. The frame has a grip base and a pair of laterally spaced legs extending from the grip base in a common direction and having a pair of transversely aligned oblong slots, respectively, extending longitudinally of the legs. The strap retainer bar has a pair of opposite arms loosely received in the respective oblong slots for sliding movement therein so that the strap retainer is movable toward and away from the grip base. In use, one end of a strap is looped around a central strap engagement portion of the retainer bar, and then passed under the base. When the strap is longitudinally tensioned, the strap retainer bar is displaced toward the base to press the strap against a strap bearing surface of the grip base. During that time, the strap retainer bar is likely to turn about the arms because the arms are loosely received in the slots. This angular movement of the retainer bar tends to reduce the holding force acting on the strap. This tendency will be greater where the central strap engagement portion has a circular, elliptical or rectangular shape in cross section, and the central strap engagement portion is disposed coaxially with the arms. In case the arms have a rectangular shape in cross section, angular movement of the strap retainer bar causes the arms to abut against the circumferential walls of the slots at diagonally opposite portions thereof with the result that the circumferential wall of the slots are deformed or damaged, thereby permitting rotation of the arms therein.

SUMMARY OF THE INVENTION

It is therefore a general object of the present invention to provide an adjustable strap fastener which can eliminate or substantially overcome the foregoing drawbacks of the prior art fasteners.

A more specific object of the present invention is to provide a molded sliding bar buckle having structural features which enable a strap retaianer bar to move linearly toward a grip base of the buckle frame without causing rotation when a strap is longitudinally tensioned, thereby holding the strap against displacement with a great holding force.

Another object of the present invention is to provide a molded sliding bar buckle having a movable strap retainer capable of imposing a large frictional resistance to a strap, thereby frictionally holding the strap with an increased holding force.

According to the present invention, a molded sliding bar buckle includes a strap retainer bar slidably mounted on an open rectangular connector frame having a grip base and a connecting bar on opposite sides of the strap retainer bar. The strap retainer bar includes a central strap engagemnt portion for retaining theraround one end portion of a strap. The strap engagement portion has on its back a sloped flat surface facing away from the grip base and having an upper end disposed adjacent to the connecting portion and a lower end disposed adjacent to the grip base, the upper end lying in a plane extending through a center of the thickness of the strap engagement portion. With this construction, when the strap is longitudinally tensioned with its one end portion looped around the strap engagement portion, a tensioning force is transformed substantially into a force or a vector acting in said plane in a direction to tend to move the strap retainer bar linearly toward the grip base. A component of the tensioning force which acts on the strap engagement portion to rotate the strap retainer bar is substantially negligible. Thus, the strap end is held firmly against displacement.

DETAILED DESCRIPTION

Figure 1:
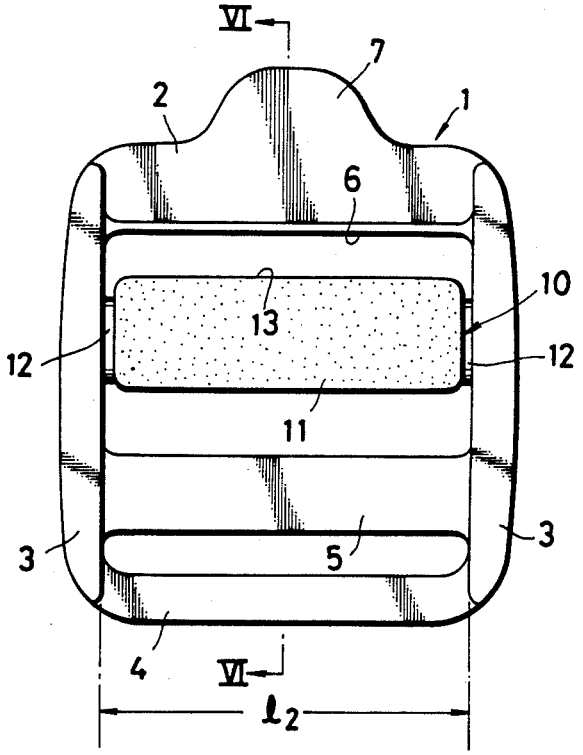
FIG. 1 is a plan view of a sliding bar buckle according to the present invention.
Figure 3:
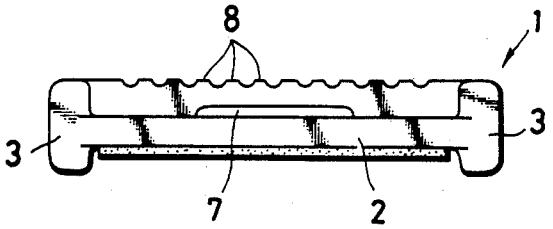
FIG. 3, appearing with FIG. 1, is a rear elevational view of FIG. 2.

FIGS. 1 through 8 show a sliding bar buckle embodying the present invention. The sliding bar buckle comprises an open or hollow connector frame 1 of a rectangular shape, and a strap retainer bar 10 movably mounted on the open connector frame 1. The open connector frame 1 and the strap retainer bar 10 are molded of synthetic resin.

The open connector frame 1 comprises an integral molded construction composed of a grip base 2, a pair of spaced parallel legs 3, 3 extending integrally from opposite ends of the grip base 2, a connecting bar 4 extending integrally between the ends of the legs 3, 3 remotely from the grip base 2, and a strap connector 5 extending integrally between the legs 3, 3 and positioned more closely to the connecting bar 4 than to the grip base 2.

The grip base 2 has a flat strap bearing surface 6 facing toward the strap connector 5 in parallel relation thereto and blending into the bottom face of the grip base 2. The grip base 2 also has an integral grip wing or tab 7 projecting away from the strap bearing surface 6. A plurality of parallel biting ridges 8 is disposed on the underside of the grip base 2 and they extend from the strap bearing surface 6.

Figure 6:
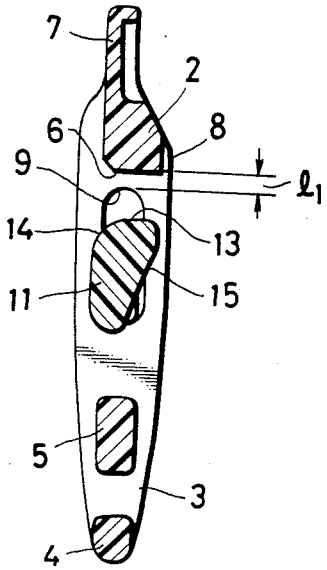
FIG. 6 is a cross-sectional view taken along line VI—VI of FIG. 1.

The legs 3, 3 have a pair of oblong slots 9, 9 respectively, extending transversely therethrough in transverse registry with each other. As shown in FIG. 6, each slot 9 has a longitudinal end spaced from the strap bearing surface 6 by a distance l1. Accordingly, the legs 3, 3 have substantial portions through which they are joined to the grip base 2. Each of the legs 3, 3 has a thickness greater than the thicknesses of the grip base 2, the connecting bar 4, and the strap connector 5.

Figure 2:
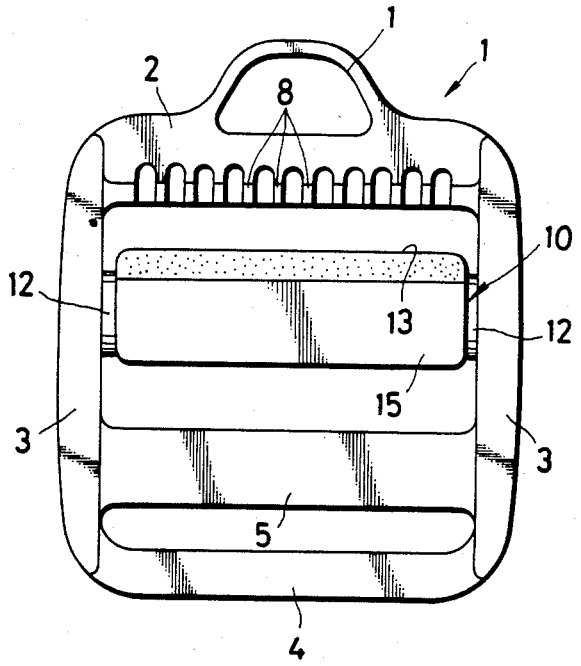
FIG. 2 is a bottom view of FIG. 1.
Figure 4:
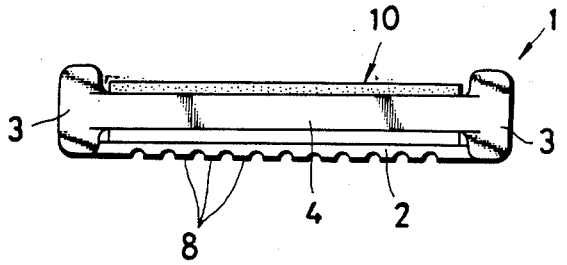
FIG. 4, appearing with FIG. 2, is a front elevational view of FIG. 1.
Figure 5:
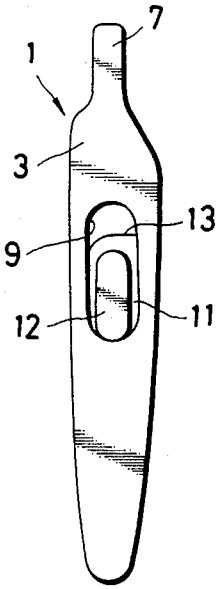
FIG. 5 is a side elevational view of FIG. 1.
Figure 7:
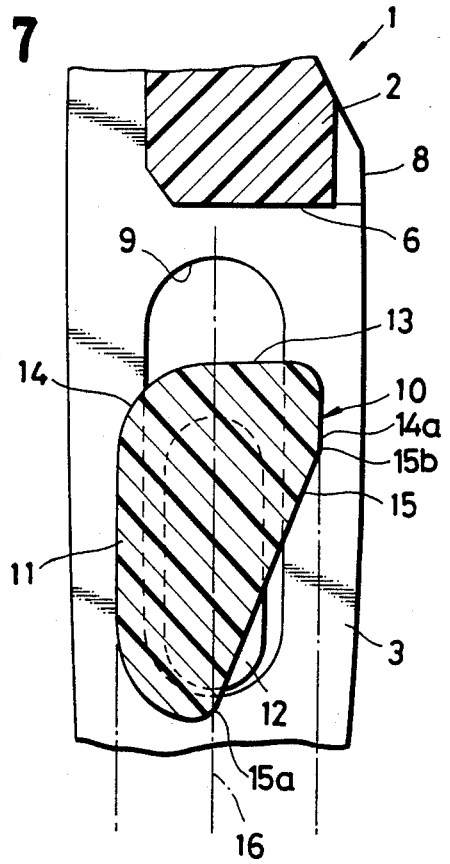
FIG. 7 is a fragmentary enlarged cross-sectional view of a portion of FIG. 6.
Figure 8:
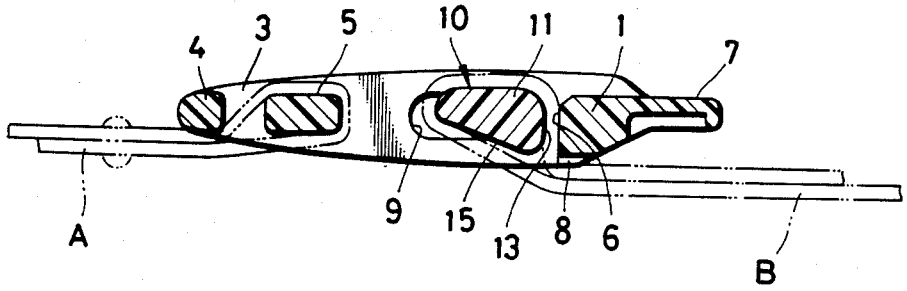
FIG. 8 is a cross-sectional view showing the manner in which the sliding bar buckle is used.

As shown in FIGS. 1 and 2, the strap retainer bar 10 is composed of an elongate central strap engagement portion 11 and a pair of aligned arms 12, 12 extending integrally from opposite ends of the central strap engagement portion 11. The arms 12, 12 have an oval cross section such that they are loosely received in the respective oblong slots 9, 9 and are slidably movable therein, but are prevented from rotating in the respective slots 9, 9. As shown in FIG. 6, the central strap engagement portion 11 includes a flat strap pressing surface 13 extending in confronting relation to the strap bearing surface 6, and an arcuately curved surface 14 extending from the flat strap pressing surface 13 and blending into a rounded face of the central strap engagement portion 11. In the illustrated embodiment, the central strap engagement portion 11, except its underside, has a roughened surface similar to a grain finish, having a multiplicity of minute projections to give an increased coefficient of friction to the central strap engagement portion 11. The central strap engagement portion 11 is thicker than the arms 12, 12, with the flat strap pressing surface 13 spaced transversely from the arms 12, 12 at least by the distance l1 (FIG. 6). The arms 12, 12 are slightly displaced out of coaxial alignment with the central strap engagement portion 11 toward the strap connector 5 (FIG. 7). With this eccentric engagement, the distance l1 can be enlarged which produces a mechanically strong pair of junctions between the grip base 2 and the legs 3, 3.

The central strap engagement portion 11 has on its back a flat sloped surface 15 inclined downwardly toward the grip base 2 and blending into a flat bottom face 14*a* (FIG. 7) of the strap engagement portion 11 which is located adjacent to the strap bearing surface 6 of the grip base 2. The flat sloped surface 15 has an upper end 15*a* disposed adjacent to the strap connector 5 and a lower end 15*b* disposed adjacent to the strap bearing surface 6 of the grip base 2, the upper end 15*a* lying in a plane 16 extending through a center of the thickness of the central strap engagement portion 11. The arms 12, 12 are disposed in the same level as the central strap engagement portion 11. As shown in FIG. 7, the strap engagement portion 11 is divided by the central plane 16 into a generally semicylindrical upper portion and a generally wedge-shaped lower portion, the strap pressing surface 13 substantially extending perpendicularly downwardly from the central plane 16.

Figure 11:
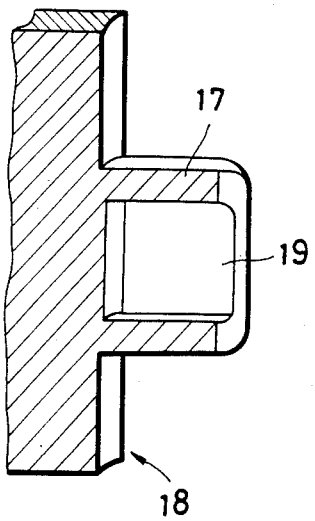
FIG. 11, appearing with FIGS. 5 and 6, is a fragmenrary perspective view, partly in cross section, of a mold for molding a portion of the sliding bar buckle illustrated in FIG. 1.

The arms 12, 12 are molded loosely but non-rotatably in the slots 9, 9 in the legs 3, 3 using a pair of molds, respectively, at the same time that the open or hollow connector frame 1 and the strap retainer bar 10 are molded. One of such molds 18 is shown in FIG. 11. The mold 18 comprises a sleeve portion 17 having an opening or recess 19. In molding operation, each of the slots 9, 9 is formed by an outer peripheral surface of the sleeve portion 17 while each arm 12 is formed by an inner peripheral surface of the recess 19. These molds constitute part of an entire mold assembly (not shown) for molding the open connector frame 11 and the strap retainer bar 10 at the same time.

In use, a strap end portion A is threaded between the connecting bar 4 and the strap connector 5 from the back to the face of the connector 5 and then between the connector 5 and the strap retaining bar 10 from the face to the back of the connector frame 1. The strap end portion A is turned over to form a loop around the strap connector 5 and is fixed to itself shown in FIG. 8. Another strap end portion B is threaded between the strap connector 5 and the strap retainer bar 10 from the back to the face of the connector frame 1 and then between the strap retainer bar 10 and the grip base 2 from the face to the back of the connector frame 11. The strap end portion B is frictionally held against the biting ridges 8 while forming a loop around the strap retainer bar 10.

Figure 9:
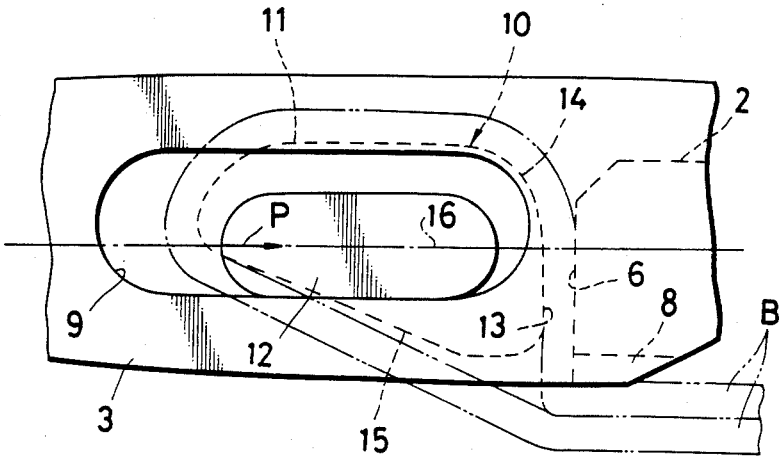
FIG. 9 is an enlarged fragmentary side elevational view of a portion of FIG. 8.

When the strap end portions A, B thus attached are tensioned longitudinally, the strap retainer bar 10 is displaced toward the grip base 2 to enable the strap pressing surface 13 to press the flat strap end portion B against the flat strap bearing surface 6. Then, the corners of the ends of the biting ridges 8 are kept in biting engagement with the strap end portion B. The strap end portion B is now prevented from being loosened off the sliding bar buckle, as shown in FIG. 9. For adjusting the length of the strap end portion B, the grip tab 7 is gripped by the user, and the connector frame 1 is turned counterclockwise (FIG. 8) through an angle of approximately 90° about the connecting bar 4 until the strap end portion B is released from engagement with the strap bearing surface 6 and the biting ridges 8. Then, the strap end portion B is longitudinally adjusted until a desired strap length is achieved.

Figure 10:
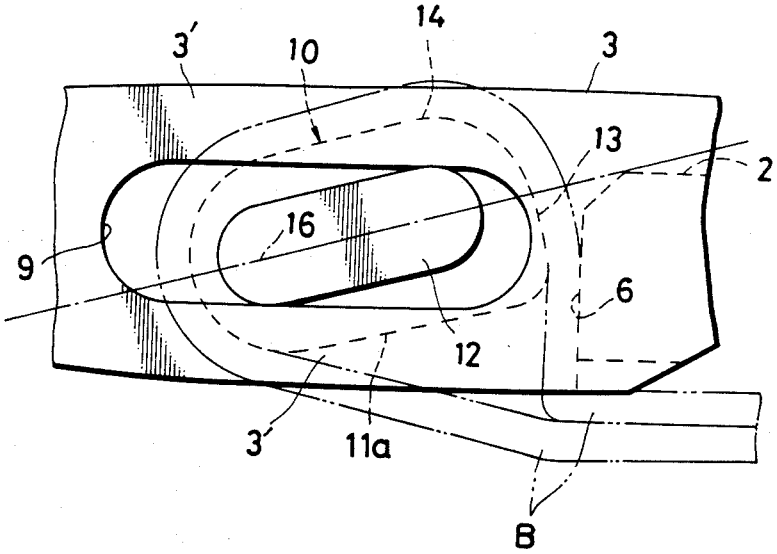
FIG. 10 (PRIOR ART)
FIG. 10 is a view similar to FIG. 9, showing a prior sliding bar buckle.

The siding bar buckle of the foregoing construction has many advantages: With the central strap engagement portion 11 having the flat sloped surface 15, when the strap is tensioned longitudinally, a component of the tensioning force which acts on the retainer bar 10 in a direction perpendicular to the central plane 16 to tend to rotate the retainer bar 10 countercloclwise in FIG. 9 is negligible. The tensioning force applied to the strap is transformed substantially into a force or vector P (FIG. 9) acting in the central plane in a direction to tend to move the strap retainer bar 10 linearly toward the grip base 2. Thus, the strap end portion B is securely held on the sliding bar buckle with a strong holding force. On the contrary, in case the strap retainer bar 10 includes a strap engagement portion 11*a* of an oval shape as shown in FIG. 10 and it has no such sloped flat surface 15, a tensioning force on the strap is mainly transformed into a component force acting on the oval strap engagement portion 11*a* in a direction perpendicular to the central plane 16 to tend to turn the retainer bar 10 counterclockwise in this figure. The strap retaining portion 11*a* thus tilted and the grip base 2 provide only a small area of contact with the strap, producing only a small frictional resistance against the strap sandwiched therebetween. This tendency becomes greater as the tensioning force is increased. The angular movement of the strap retainer bar 10 causes the arms 12 to abut against the circumferential walls of the slots 9 at diagonally opposite portions thereof with the result that the circumferential walls are deformed or damaged, thereby permitting rotation of the arms 12 therein.

Both the strap bearing surface 6 (FIG. 9) and the strap pressing surface 13 are flat and parallel to one another and the strap pressing surface 13 is disposed substantially below the central plane 16 of the strap engagement portion 11 with the result that the strap end portion B is gripped between these surfaces 6, 13 below the central plane 16. Such gripping system prevents the retainer bar 10 from being turned when the retainer bar 10 is subjected to a vector force acting thereon in a direction perpendicular to the central plane 16 of the strap engagement portion 11. The legs 3, 3 are transversely spaced from each other by a distance l2 (FIG. 2) slightly narrower than the width of a strap used by 0.3 mm to 0.5 mm, for example. This negative clearance is preferable in that the strap as retained on the strap retainer bar 10 will not be released or loosened, due to frictional resistance between lateral edges of the strap and the legs 3, 3 as when the strap becomes free of tensioning forces or the bag on which the sliding bar buckle is used is not carried by the user. Accordingly, there is no need for strap readjustment when the bag is carried by the user again. If the distance l2 were larger than the width of a strap used, the strap would easily be loosened off the sliding bar buckle or the latter would move relatively to the strap when the strap is released of tensioning forces.

The strap end portion A may be attached to the connecting bar 4 in the manner described above in which case the strap connector 5 may be omitted.

Figure 12:
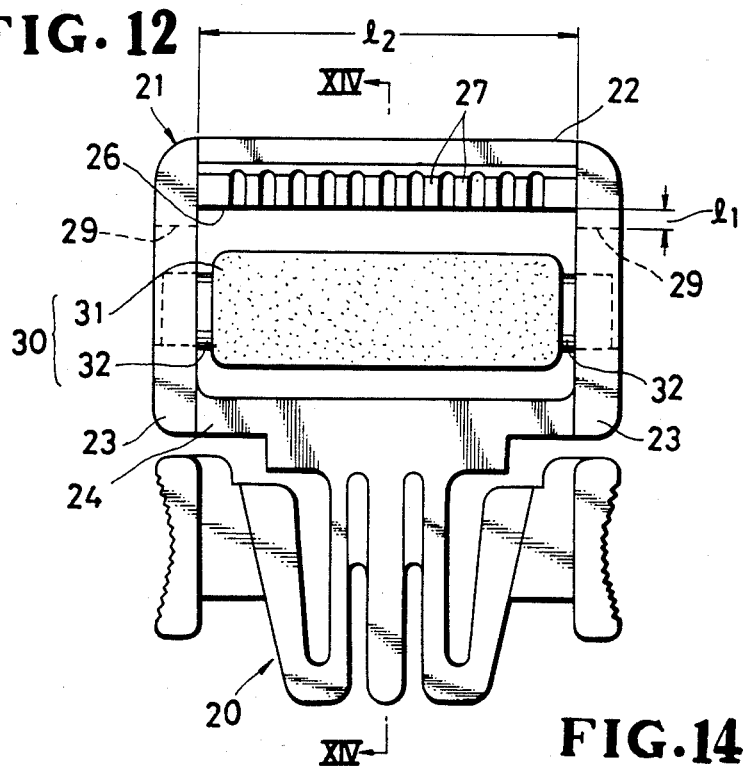
FIG. 12 is a plan view of another embodiment of the present invention.
Figure 13:
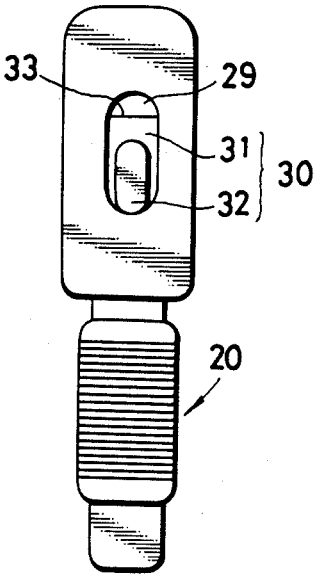
FIG. 13 is a side elevational view of FIG. 12.
Figure 14:
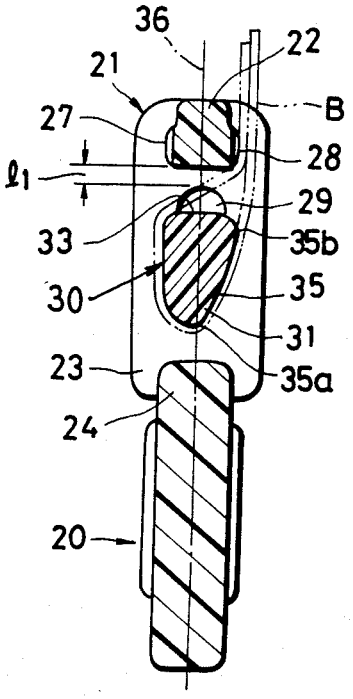
FIG. 14 is a cross-sectional view take along line XIV—XIV of FIG. 12.

FIGS. 12 through 14 illustrate a sliding bar buckle according to another embodiment of the present invention. The sliding bar buckle is suitable for use, for example, as a male member of a buckle assembly on each of a pair of suspenders.

The sliding bar buckle includes an integrally molded construction composed of a male member 20, an open or hollow connector frame 21, and a strap retainer bar 30 movably mounted on the open connector frame 21. The male member 20, the connector frame 21, and the strap retainer bar 30 are all made of synthetic resin. The connector frame 21 comprises a base 22, a pair of legs 23, 23 extending integrally from opposite ends of the base 22 in a common direction, and a connecting bar 24 extending integrally between the legs 23, 23 at the distal ends thereof remote from the base 22.

The base 22 has a flat strap bearing surface 26 facing toward the connecting bar 24. The base 22 has a plurality of biting ridges 27, 28 on its opposite surfaces, the biting ridges 27, 28 extending parallel to the legs 23, 23 from the strap bearing surface 26 of the base 22. The biting ridge 27, 28 have end surfaces facing toward the connector bar 24. The legs 23, 23 have a pair of oblong slots 29, 29 in transverse registry with each other, the slots 29, 29 having ends spaced a distance l1 from the strap bearing surface 26 as shown in FIGS. 12 and 14. Thus, a pair of junctions between the base 22 and the legs 23, 23 is mechanically strengthened.

The strap retainer bar 30 is composed of a central strap engagement portion 31 and a pair of coaxial arms 32, 32 of substantially oval cross section extending from opposite ends of the central strap engagement portion 31. The arms 32, 32 are loosely received in the oblong slots 29, 29, respectively for sliding movement therein, but are prevented from rotating in the respective slots 29, 29. The central strap engagement portion 31 has a strap pressing surface 33 facing toward and lying parallel to the strap bearing surface 26. The central strap engagement portion 31 has a roughened surface similar to a grain finish extending over the periphery except the underside thereof. Further, the central strap engagement portion 31 is thicker than the arms 32, 32 with the flat strap pressing surface 33 spaced transverely from the arms 32, 32 at least by the distance l1 (FIG. 13). The arms 32, 32 are slightly displaced out of coaxial alignment with the central strap engagement portion 31 toward the connecting bar 24. This eccentric arrangement enables the distance l1 to be enlarged with the result that a pair of mechanically strong joints can be provided between the base 22 and the legs 23, 23.

The central strap engagement portion 31 has on it underside a sloped gently curving but substantially flat surface 35 inclined downwardly toward the grip base 22 and blending into the strap engagement portion 31. As shown in FIG. 14, the sloped gently curving but substantially flat surface 35 has an upper end 35*a* disposed adjacent to the connecting bar 24 and a lower end 35*b* disposed adjacent to the strap pressing surface 33, the upper end 35*a* lying in a plane 36 extending through a center of the thickness of the strap engagement portion 31. The arms 32, 32 and the strap engagement portion 11 are disposed in the same plane 36 but they are eccentric with each other.

The strap retainer bar 30 can be molded at the same time that the connector frame 21 is molded so that they are molded in an assembled condition. Such molding operation can be accomplished by using the mold 18 shown in FIG. 11.

The sliding bar buckle thus described will be used as follows: A strap end portion B is threaded between the strap retainer bar 30 and the connecting bar 24 from the back to the face of the connector frame 21 and then threaded back between the strap retainer bar 30 and the base 22, thus providing a loop around the strap retainer bar 30, as shown in FIG. 14. The male member 20 is frictionally inserted into a female member (not shown). When the strap is tensioned longitudinally, the strap retainer bar 30 is disposed toward the base 22 until the strap end B is pressed by the strap pressing surface 33 against the strap bearing surface 26. At this time, a component of a tensioning force which acts on the strap retainer bar 30 to tend to turn the latter in the counterclockwise direction (FIG. 14) is substantially negligible and therefore the tensioning force is transformed substantially into a force acting in the plane 36 in a direction to move the retainer bar 30 linearly toward the grip base 22. The strap pressing surface 33 which extends downwardly from the central plane 36, serves to prevent angular movement of the retainer bar 30. The strap end portion B is also engaged securely by corners of the biting ridges 28 (or ridges 27 is threaded from other side) against forces tending to loosen the strap end portion B off the connector frame 21. To adjust the length of the strap, the base 22 is gripped by the user and turned counterclockwise (FIG. 14) about the connector bar 24 through an angle of 90° until the strap end portion B is disengaged from the biting ridges 28. The strap retainer bar 30 is then displaced from the base 22, and the strap end portion B can be pulled in either direction for length adjustment.

The legs 23, 23 are transversely spaced from each other by a distance l2 slightly smaller than the width of the strap used by 0.3 mm to 0.5 mm, for example so that the strap will frictionally be engaged edgewise by the legs 23, 23 when the strap is released of any tension. This feature prevents the strap from being loosened accidentally when not in use.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A sliding bar buckle comprising:

(a) a molded connector frame of synthetic resin including (1) a grip base having a strap bearing surface, (2) a pair of spaced legs extending integrally from opposite ends of said grip base and having a pair of transversely aligned oblong slots, respectively, spaced from said grip base by a distance, and (3) a connecting bar extending integrally between said legs remotely from said grip base; and (b) a strap retainer of molded synthetic resin including (1) a central strap engagement portion having a strap pressing surface for frictionally pressing a strap end portion against said strap bearing surface, and a sloped surface on its back inclined downwardly toward said strap bearing surface, said sloped surface having an upper end disposed adjacent to said connecting portion and a lower end disposed adjacent to said grip base, said upper end lying in a plane extending through a center of the thickness of said central strap engagement portion, and (2) a pair of arms extending integrally from opposite ends of said central strap engagement portion and loosely non-rotatably fitted in said oblong slots, respectively, said arms being disposed out of coaxial alignment with said central strap engagement portion toward said connecting bar, said arms being transversely spaced from said strap pressing surface by said distance.

2. A sliding bar buckle according to claim 1, said strap bearing surface and said strap pressing surface extending parallel to one another in confronting relation, said strap pressing surface extending substantially perpendicularly from said plane of said central strap engagement portion.

3. A sliding bar buckle according to claim 1, said sloped surface being flat.

* * * * *